US008480085B2

(12) United States Patent
Cooke et al.

(10) Patent No.: US 8,480,085 B2
(45) Date of Patent: Jul. 9, 2013

(54) ITEM STORAGE

(75) Inventors: Nicholas Cooke, Scotland (GB); Steven Carnegie, Scotland (GB)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/307,937

(22) Filed: Nov. 30, 2011

(65) Prior Publication Data

US 2013/0134179 A1 May 30, 2013

(51) Int. Cl.
*B65H 5/02* (2006.01)

(52) U.S. Cl.
USPC ..... 271/275; 242/437; 242/528

(58) Field of Classification Search
USPC .... 271/275, 216; 242/528, 437, 437.1–437.4, 242/613.3
See application file for complete search history.

(56) References Cited

U.S. PATENT DOCUMENTS

| | | | | |
|---|---|---|---|---|
| 3,743,200 | A * | 7/1973 | Hommerin | 242/528 |
| 5,533,627 | A * | 7/1996 | Nordqvist | 209/534 |
| 6,383,590 | B1 * | 5/2002 | Kao | 428/36.91 |
| 7,494,122 | B2 * | 2/2009 | Spinetti | 271/216 |
| 8,162,308 | B2 * | 4/2012 | Kobayashi et al. | 270/60 |
| 2011/0068528 | A1 * | 3/2011 | Kobayashi et al. | 270/58.07 |

* cited by examiner

*Primary Examiner* — Michael McCullough
(74) *Attorney, Agent, or Firm* — Paul W. Martin

(57) ABSTRACT

An apparatus and method are disclosed for temporarily storing at least one item of media. The apparatus includes a rotatable item support member arranged to rotate about a support member axis of rotation and comprising an outer support surface. The apparatus also includes a pair of drive tape members, each arranged along a respective tape pathway, each tape pathway comprising a pathway portion in which the tape members extend in a co-operating relationship supported by said outer support surface. The outer support surface includes at least one support region that supports the tape members and an item located therebetween in a flat orientation.

15 Claims, 4 Drawing Sheets

ITEM STORAGE

FIELD OF THE INVENTION

The present invention relates to a method and apparatus for temporarily storing at least one item of media at a storage location. In particular, but not exclusively, the present invention relates to the temporary storage of currency notes on a rotating support structure in a self-service terminal or teller assist unit or cash recycler unit or the like.

BACKGROUND TO THE INVENTION

As the bank branch becomes a primary delivery channel for financial institutions, there is a constant need to improve operational efficiency and provide users with an improved quality of service. Most financial institutions have in the past had a defined system in place determining how currency notes were physically handled in a branch. Typically, there has been a secure vault where bulk currency notes are stored and these are distributed after multiple counts to tellers who can then perform necessary cash transactions with customers. Likewise, when cash has been received from customers, this has been counted many times and eventually returned as incoming cash to a vault. It has thus not been uncommon for currency notes to be counted by hand many times on a journey through a branch. Such cash handling procedures have decreased employee efficiencies and increased customer wait times. There has thus been a need to reduce exposed currency notes in a branch.

As technology has improved, attempts have been made to automate certain aspects of the currency note handling process. Such technology allows for remote note imaging or check imaging, signature capture and other such verification steps. The development of such technology has led to the introduction of media depositories used in automated teller machines (ATMs) and other such self-service terminals. Media depositories are used to receive media items from a customer. One common type of media depository is a sheet media depository for receiving items of media in sheet form. For example, such items of media can be currency notes, checks, tickets, gyros or the like. Some sheet depositories are capable of receiving a bunch of sheet items of media in a loading area and then picking individual sheets from a bunch so that each sheet can then be identified and validated individually prior to storage of a validated sheet within a depository or returned to a customer.

Another type of automated unit is the currency recycler. In such devices, customers may deposit items of media such as currency notes, checks, vouchers or the like, and these are processed separately one-by-one and stored in various storage modules within a terminal. For example, a storage unit can be an escrow storage unit in which, instead of being deposited directly into a storage module, once counted and verified, currency notes or checks input by a user are held temporarily until a teller negotiating with a user completes a transaction. If a customer decides to cancel a transaction or asks for the items to be recounted, the original deposited bank currency notes can be returned. This function allows any disputes to be resolved promptly. The temporarily stored items are held in a roll storage module (RSM) in the escrow module.

Cash recyclers and other such units also include one or more roll storage modules (RSMs). Such RSMs are provided for each of the possible currency notes or checks or other such vouchers which may be presented at a recycler unit. For example, an RSM dedicated to a £10 note will be provided as well as an RSM dedicated to a £20 note as well as an RSM dedicated to a £50 note or the like.

When a customer presents a bunch of items, these do not need to be manually counted by a teller, but are instead fed into an input slot on the recycler unit. Each presented item is counted and verified within a recycler and once it has been decided to make a permanent deposit of the presented items, the items are separated and stored in a respective RSM. For example, all £20 notes presented in a bunch are stored in the £20 RSM etc.

A cash recycler thus helps automate acceptance, authentication and validation of currency notes. Another advantage of such units is that the deposited items which are stored in respective RSMs can subsequently be dispensed when another user attends at a teller and requests currency notes. A cash recycler thus enables previously deposited currency notes to be instantly available for dispensing to customers.

Cash recyclers also help reduce transaction times and time taken for start and end-of-day cash balancing. Average wait times for customers can thus be reduced and overall branch security is improved.

It is understood that there are other self-service terminals and other item storage devices where sheet items of media are stored on a semi-permanent basis for subsequent dispensation of the stored items to a user requesting them. On many occasions the rolled storage units utilized can store items for many hundreds, if not thousands, of hours in a curved state. This is because such storage units typically utilize a storage drum having a substantially cylindrical cross-section. Currency notes or checks or the like are stored by being wrapped around the drum and kept in place and duly located by one or more tape windings which are wound around the drum. A problem with such storage mechanisms is that when the items are dispensed, because they may have been stored for some time, they may retain part of the curved shape generated by being wrapped on a cylindrical drum. This effect can be worsened if the stored item was already badly curved prior to being stored. Such curled items of media have a tendency to increase a risk of jams occurring within a storage unit. Also, within the transport system utilized to move items of media around in a self-service terminal or the like, the risk of such jams is increased with curled or curved items.

SUMMARY OF THE INVENTION

It is an aim of the present invention to at least partly mitigate the above-mentioned problems.

It is an aim of certain embodiments of the present invention to provide an apparatus and method which can temporarily store one or more items of media in a way which prevents stored items acquiring a curved shape.

It is an aim of certain embodiments of the present invention to provide a method and apparatus for temporarily storing one or more items of media in a way which helps flatten incoming items of media which have a crumpled or already curved shape.

It is an aim of embodiments of the present invention to provide a method and apparatus that eliminates a returned curved shape of items of media stored on a rotating item support.

According to a first aspect of the present invention there is provided an apparatus for temporarily storing at least one item of media, comprising:

a rotatable item support member arranged to rotate about a support member axis of rotation and comprising an outer support surface; and a pair of drive tape members each arranged along a respective tape pathway, each tape pathway comprising a pathway portion in which the tape members extend in a co-operating relationship supported by said outer support surface; wherein the outer support surface comprises at least one support region that supports the tape members and an item located therebetween in a flat orientation.

The support region preferably stores media items without imparting a kink, curve, or bend to the media items either during storage or once they are removed from the support region. This may be achieved using a generally planar surface.

As used herein, the words "flat" and "generally planar" are used in a practical sense (rather than in a purely geometrical sense) and are intended to cover (i) regions that are planar, and also (ii) regions that have some surface profiling (for example small bumps, ridges, and/or stipples) provided that the surface profiling does not impart a kink, curve, or bend to the item.

Aptly, said at least one planar support region comprises a plurality of planar support regions arranged circumferentially around the outer support surface.

Aptly, each planar support region comprises a smooth planar area at least large enough to support an entire item of media.

Aptly, each support region has a planar area of about around 105 $cm^2$ or about around 135 $cm^2$.

Aptly, the pair of drive tape members comprises only one tape element secured at a central region thereof to the item support member, each belt member comprising a respective portion of the tape element extending away from the central region, or the pair of drive tape members comprises two tape elements each secured at a respective first end region to the item support member.

Aptly, the apparatus further includes at least one driven reel element at a second end of each tape member.

Aptly, in a deposit mode of operation, each reel element is driven at a reel speed slower than a support speed at which the support member is driven and in a dispense mode of operation each reel element is driven at a reel speed faster than a support speed at which the support member is driven.

Aptly, at least one tape member comprises an indicator element that identifies a pre-determined position on the respective tape member.

Aptly, the apparatus further includes a plurality of guide pulleys that locate each tape pathway.

Aptly, the item support member and the tape members are selectively driven simultaneously and synchronously.

Aptly, the apparatus further includes a drive motor and at least one clutch element, wherein the drive motor and clutch element drive the support member and the tape members in a dispense mode of operation or a deposit mode of operation.

According to a second aspect of the present invention, there is provided a self-service terminal which comprises apparatus for temporarily storing at least one item of media, comprising:

a rotatable item support member arranged to rotate about a support member axis of rotation and comprising an outer support surface; and a pair of drive tape members each arranged along a respective tape pathway, each tape pathway comprising a pathway portion in which the tape members extend in a co-operating relationship supported by said outer support surface; wherein the outer support surface comprises at least one support region that supports the tape members and an item located therebetween in a flat orientation, and wherein each item of media comprises a currency note.

According to a third aspect of the present invention, there is provided a teller assist unit, comprising apparatus for temporarily storing at least one item of media, comprising:

a rotatable item support member arranged to rotate about a support member axis of rotation and comprising an outer support surface; and a pair of drive tape members each arranged along a respective tape pathway, each tape pathway comprising a pathway portion in which the tape members extend in a co-operating relationship supported by said outer support surface; wherein the outer support surface comprises at least one support region that supports the tape members and an item located therebetween in a flat orientation, and wherein each item of media comprises a currency note.

According to a fourth aspect of the present invention, there is provided a cash recycler unit comprising which comprises apparatus for temporarily storing at least one item of media, comprising:

a rotatable item support member arranged to rotate about a support member axis of rotation and comprising an outer support surface; and a pair of drive tape members each arranged along a respective tape pathway, each tape pathway comprising a pathway portion in which the tape members extend in a co-operating relationship supported by said outer support surface; wherein the outer support surface comprises at least one support region that supports the tape members and an item located therebetween in a flat orientation, and wherein each item of media comprises a currency note.

According to a fifth aspect of the present invention, there is provided a method for temporarily storing at least one item of media, comprising:

rotating an item support member comprising an outer support surface about an item support axis of rotation;

driving tape members along respective tape pathways each comprising a respective pathway portion in which the tape members extend in a co-operating relationship supported on said outer support surface; and supporting the tape members and at least one item of media located therebetween in a flat orientation on at least one support region of the outer support surface.

Aptly, the method further comprises collecting a plurality of items of media one-by-one as the item support rotates by supporting consecutive items of media on consecutive planar support regions as the item support member rotates.

Aptly, the method further comprises rotating the item support media and driving the belt member simultaneously and synchronously.

Aptly, the method further comprises, for each supported item of media, supporting the entire item of media on a flat surface of a respective one support region of the item support member.

Aptly, the method further comprises driving the belt member by driving at least one driven reel element at each of a first and further respective end region of the belt member.

According to a sixth aspect of the present invention, there is provided a product which comprises a computer program comprising program instructions for:

rotating an item support member comprising an outer support surface about an item support axis of rotation;

driving tape members along respective tape pathways each comprising a respective pathway portion in which the tape members extend in a co-operating relationship supported on said outer support surface; and supporting the tape members and at least one item of media located therebetween in a flat orientation on at least one support region of the outer support surface.

Certain embodiments of the present invention provide the advantage that a rolled storage module can be provided in which items of media such as currency notes, checks or the like are stored in a substantially planar orientation. As such, the items may be stored for a considerable time without risk of acquiring a curved shape. Thus, the risk of jams when such items are subsequently dispensed is eliminated or at least greatly reduced.

Certain embodiments of the present invention provide the advantage that very many items of media may be stored in an RSM in a substantially flat orientation. For example, many hundreds or even thousands of separate items may be stored in a single RSM.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
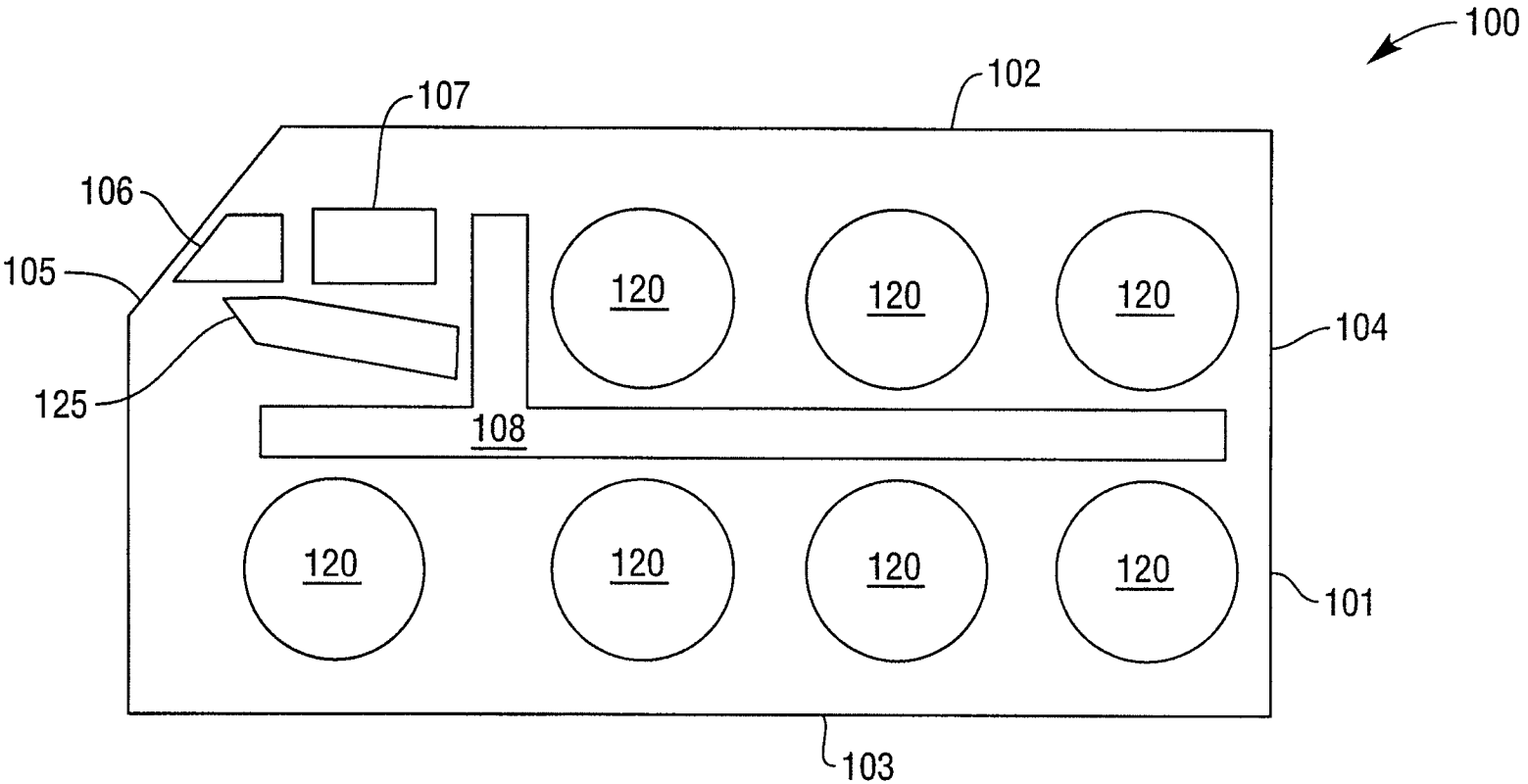
FIG. 1 is a schematic diagram of a teller assist unit according to an embodiment of the present invention.

In the drawings like reference numerals refer to like parts.

FIG. 1 illustrates a teller assist unit 100 according to an embodiment of the present invention. It will be understood that certain embodiments of the present invention are not restricted to storage units within a teller assist unit but optionally may be used in automated teller machines (ATMs), cash recyclers, vending machines or the like wherever sheet items of media such as currency notes, checks, vouchers, pages or the like are to be stored and/or deposited. The teller assist unit 100 includes a secure housing 101 which includes a top wall 102 and floor standing wall 103, together with a back wall 104 and a front fascia wall 105. The front fascia includes a bill, entry/exit slot 106 at which a user can present a bunch of currency notes or checks or single currency notes or checks or other such items of media for deposit. The bill entry/exit slot 106 is also the outlet slot whereby items of media such as currency notes and/or checks are returned or are dispensed to a user dependent upon a user requirement. In the instance of a teller assist unit, the user is a teller of a bank branch or other such authorized user who acts as an interface with a bank customer. Currency notes or checks deposited are validated by a bill validator 107, as will be understood by those skilled in the art. A bill transport path 108 which includes one or more rollers and/or endless belts is used to locate items of media one-by-one at a desired roll storage module 120.

In addition to handling deposits the teller assist unit can be utiliutilizedispense currency notes which are stored in the roll storage modules. For example, if a teller requires £120 worth of currency notes, this information may be input at a user interface (not shown) on the front fascia 105 of the teller assist unit and then a central processing unit (not shown) initiates selection of currency notes from one or more roll storage modules. For example, to dispense £120, the roll storage module (RSM) which holds £20 notes may be placed in a dispense mode of operation in which six previously stored £20 notes are dispensed from the RSM onto the bill transport path 108. A bill return path module 125 is utilized to locate dispensing items from the bill transport path 108 to the exit slot 106. It will be understood that rather than dispensing six £20 notes from a single RSM, the teller assist unit may be selectively operated to dispense two £50 notes from a £50 note RSM and two £10 notes from a £10 note RSM. Other combinations are of course possible.

Figure 2:
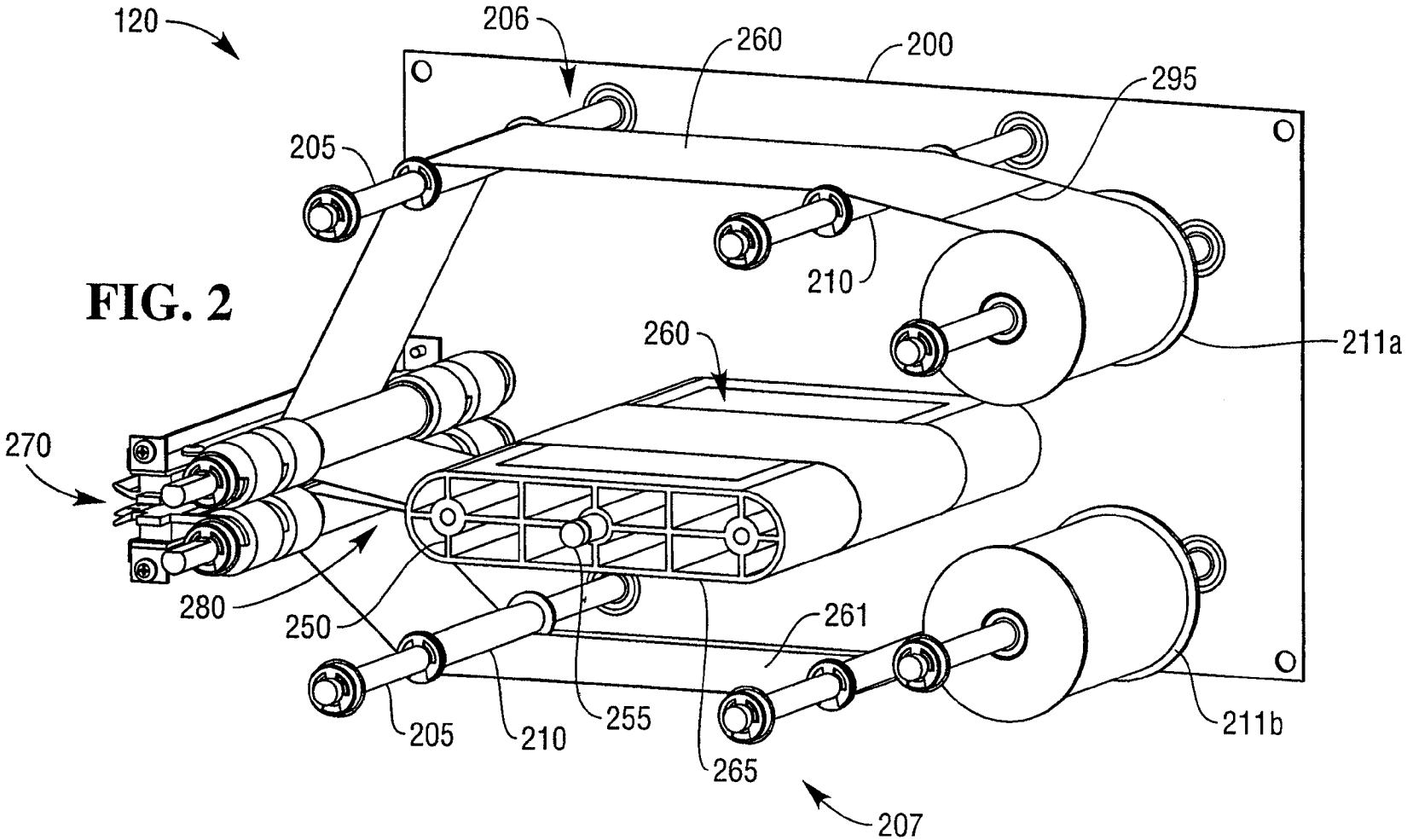
FIG. 2 illustrates a rotatable item support according to a first embodiment of the present invention having planar support regions and co-operating tapes.

FIG. 2 illustrates parts of an RSM 120. Each RSM includes a secure box formed from a back plate 200 which is spaced apart from, and substantially parallel with, a front wall 201 (not shown). The front and back walls are closed by opposed end walls and top and bottom walls (also not shown).

Multiple shafts 205 extend between the front and back plates. Eight such shafts are shown in FIG. 2, although the specific number will be determined by the particular layout in a particular RSM. Each shaft 205 extends from a first end 206 thereof, which is secured to the back plate 200 to a second end 207 thereof, which is secured to the front plate (not shown). The shafts are fixed in place and carry a rotatable sleeve 210 or a driven reel 211*a*, 211*b*. Each reel 211 includes a cylindrical body having a disc at each end thereof. Each reel is thus like a cotton reel-shaped body. A resilient tape is wound around the reels and the shafts.

Each RSM also includes a rotatable item support 250 which rotates about a longitudinal axis defined by a support shaft 255. The drive shaft 255 is driven by a drive system which may optionally also drive the rotation of the reels 211*a*, 211*b*. As shown in FIG. 2, according to a first embodiment of the present invention, the rotatable item support has a substantially rounded rectangular cross-section and extends along a longitudinal axis. A top surface 260 of the support is substantially planar and smooth and flat. This area provides a resting surface on which tape and/or currency notes may be supported in a flat configuration. The cross-sectional area of each planar support region is sized so as to be at least as large as a largest currency note or check or the like, which is predicted to be deposited and stored in the RSM. Aptly, each support region has a planar area of about around 105 $cm^2$ or more or less. Aptly, the support region has a planar area of about around 135 $cm^2$. Aptly, each support region has a planar area of about around 155 $cm^2$. As illustrated in FIG. 2, the support member shown has a further planar support region 265 on the lower surface of the support member 250. The planar support regions are joined together by curved, smooth surfaces at the outer surface of the support member.

As illustrated in FIG. 2, each RSM includes an inlet slot 270 at which items of media transported by the bill transport system 108 are periodically presented one-by-one. This slit 270 is also used as an outlet slit whereby items of media previously stored on the support member may be unwrapped and dispensed through the exit slit 270 to the bill transport system 108 and the bill return path 125 for exit via exit slot 106 to a teller.

When a teller presents one or more currency notes at a bill entry slot 106 of the teller assist unit, these are transported one-by-one subsequent to bill validation via the bill transport system 108 and presented one-by-one at the inlet slit 270. The storage support 250 is rotated in an anti-clockwise direction by a drive motor. Simultaneously, the drive motor system drives the reels of tape 211*a*, 211*b*. In a deposit mode of operation the item support 250 is rotated more quickly than the rotation of the tape reels. This keeps each tape relatively taut as incoming items of media are wrapped around the item support.

In the embodiment shown in FIG. 2, two tapes are provided. One tape 260 is secured at a first end to the item support and is wrapped there around and extends across the pulley system to the upper reel 211*a*. The further tape 261 is also attached at a first end thereof to the item support and then extends to the second lower reel 211*b*. It will be appreciated that instead of utilizing two separate tapes, one long tape could be utilized which is fixed at a central position to the item support.

Incoming items of media are located between opposed upper and lower surfaces of the two tapes at an incoming region 280. The two tapes at this region co-operate so that an incoming item of media is sandwiched there between. Rotary motion of the support winds the two tapes together with an item of media located there between onto the support member. The rotation of the support and the tapes is timed together with the presentation point of an item of media so that the item of media, such as a currency note, is stored wholly on a single flat surface of a planar support region of the item support. As the item support rotates further, items of media are deposited one-by-one on consecutive planar support regions. The net effect is that after a period of time, multiple currency notes are stored with intervening tape windings on each of the two planar support surfaces of the item support.

In a dispense mode of operation, currency notes previously stored on the item support must be removed and thereafter transferred to a bill exit slot 106 on the teller assist unit. Depending upon a number of currency notes which are needed, the upper reel 211*a* and lower reel 211*b* are driven so as to pull the tapes (and the currency notes stored therewith) off the also rotating item support. In the dispense mode of operation the item support shown in FIG. 2 is driven in a clockwise direction. One-by-one currency notes which are bound together between the opposed tape sections are carried with the tape off the item support to the region 280 where the two tapes are closely juxtaposed and thereafter ejected through the exit slot 270.

Because the currency notes and tape are stored on planar, smooth, flat surfaces, there is no inclination for the currency notes to acquire a curved shape despite, perhaps, being stored for many hundreds or thousands of hours on a support surface.

There will of course be a limit to the number of items of media which can be stored on any single item support. This will in many respects be determined by the length of tape available and wrapped around each of the upper and lower reels 211. At least one of the reels (shown in the upper tape section of FIG. 2) includes a marking line 295 which is carried on the tape. A detector (not shown) continually monitors for identification of this line or other such indicator which indicates that the reel is becoming empty and thus that a maximum storage capacity has almost been reached.

Figure 3:
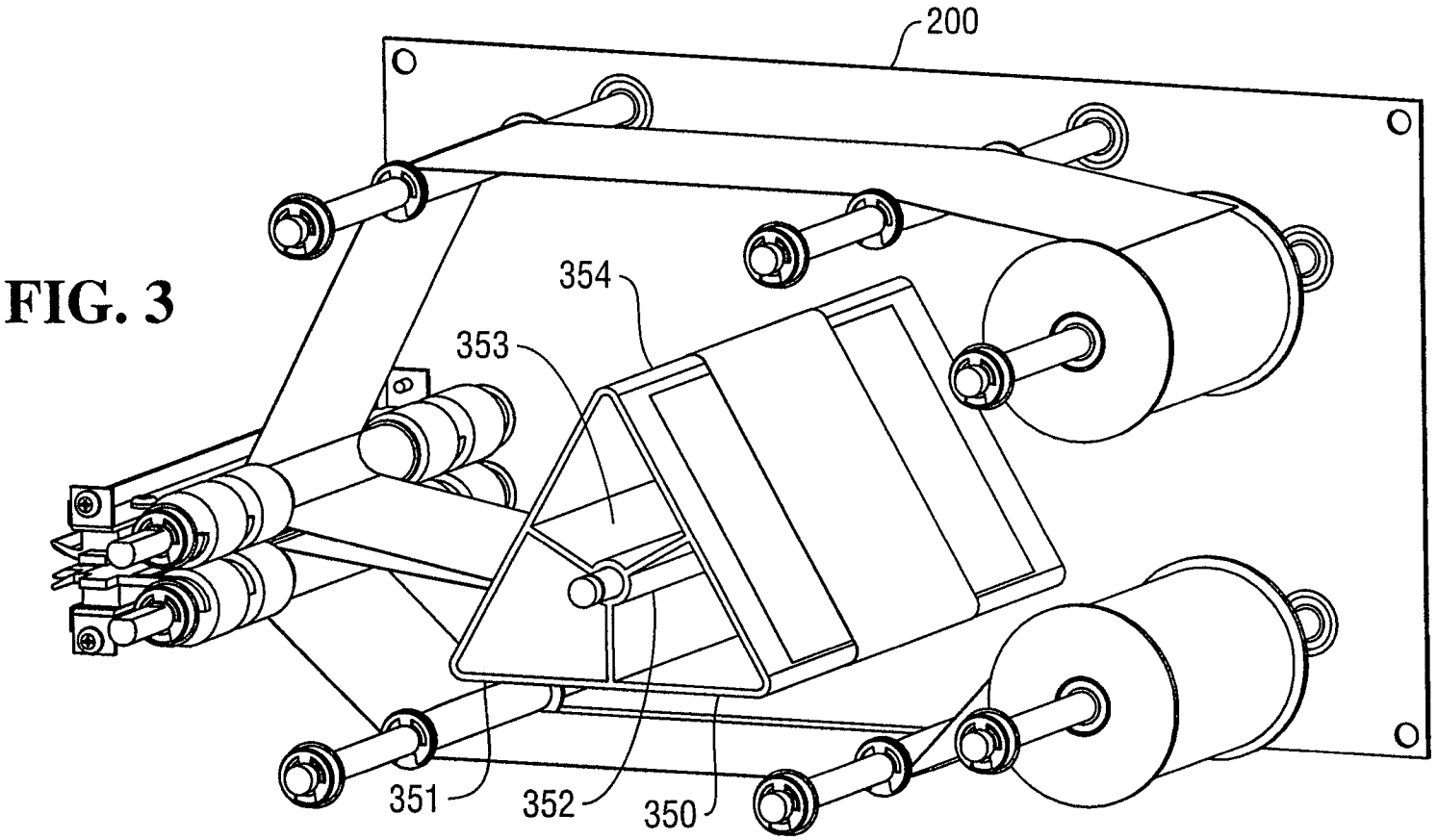
FIG. 3 illustrates a support member according to a second embodiment of the present invention which includes multiple planar support regions.

FIG. 3 illustrates an alternative embodiment of the present invention, in which the item support 350 is substantially triangular in cross-section. As such, the item support includes three planar surfaces, each of which is substantially smooth and flat and which is sized so as to wholly support a currency note that is to be stored in that particular RSM. As illustrated in FIG. 3, the item support includes three spaced apart substantially planar walls 351 which are secured to a central sleeve 352 by respective connecting plates 353. The smooth, flat walls 351 are connected together by curved regions 354 to prevent the tapes which are wrapped around the item support from being abraded. As the central shaft 255 rotates, the item support rotates. The item support rotation is driven in a deposit mode of operation slightly more quickly than the speed of rotation of the storage reels. In a dispense mode of operation, the reels are rotated slightly more quickly than the speed of rotation of the item support. This maintains the tapes in a taut state at all times so that items of media can be duly deposited or dispensed or dispensed as appropriate.

Figure 4:
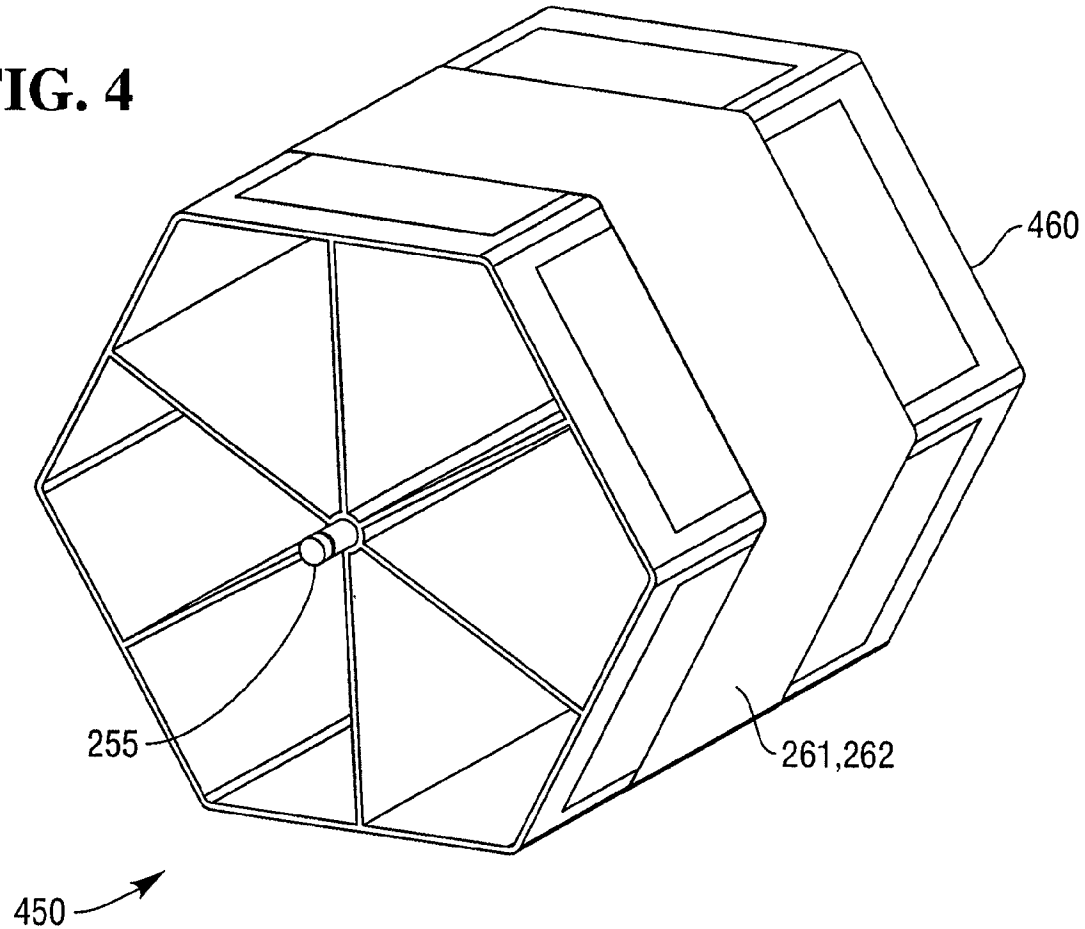
FIG. 4 illustrates a rotatable item support according to a third embodiment of the present invention including multiple planar support regions.

FIG. 4 illustrates an alternative item support 450, according to another embodiment of the present invention, which includes six substantially flat surfaces 460, spaced apart substantially circumferentially around a central drive shaft 255. Other parts similar to those shown in FIGS. 2 and 3 are not illustrated in FIG. 4 for convenience.

It will be understood that an item support may have one, two or more planar surfaces. The number of support surfaces is only limited by the practical size of a storage module and the fact that each planar support region must be large enough to support a whole item.

It will be appreciated that certain embodiments of the present invention are not restricted to the location of a single item of media on a single planar storage surface. For example, as shown in FIG. 4, when planar regions are adjacent and not angled too much with respect to one another, a single item of media could be bent in one or possibly two locations and stored in a substantially flat manner on multiple adjacent planar support surfaces. This would introduce a possible risk of creasing where an item is held across a joint between adjacent planar regions but would nevertheless provide an improvement upon current systems which produce curved items of media.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. Apparatus for temporarily storing at least one item of media, comprising:

a rotatable item support member having a substantially rounded rectangular cross-section with straight sides and rounded ends and arranged to rotate about a support member axis of rotation and comprising an outer support surface; and a pair of drive tape members each arranged along a respective tape pathway, each tape pathway comprising a pathway portion in which the tape members extend in a co-operating relationship supported by said outer support surface and the rounded ends of the item support member;

wherein the outer support surface comprises at least one support region that supports the tape members and an item located therebetween in a flat orientation.

2. The apparatus as claimed in claim 1, further comprising:

said at least one support region comprises a plurality of planar support regions arranged circumferentially around the outer support surface.

3. The apparatus as claimed in claim 1, further comprising:

each support region comprises a smooth planar area at least large enough to support an entire item of media.

4. The apparatus as claimed in claim 3, wherein each support region has a planar area of about around 105 $cm^2$ or about around 135 $cm^2$.

5. The apparatus as claimed in claim 1, further comprising:

the pair of drive tape members comprises only one tape element secured at a central region thereof to the item support member, each belt member comprising a respective portion of the tape element extending away from the central region, or the pair of drive tape members comprises two tape elements each secured at a respective first end region to the item support member.

6. The apparatus as claimed in claim 5, further comprising:

at least one driven reel element at a second end of each tape member.

7. The apparatus as claimed in claim 6, further comprising:

in a deposit mode of operation, each reel element is driven at a reel speed slower than a support speed at which the support member is driven and in a dispense mode of operation each reel element is driven at a reel speed faster than a support speed at which the support member is driven.

8. The apparatus as claimed in claim 1, further comprising:

at least one tape member comprises an indicator element that identifies a pre-determined position on the respective tape member.

9. The apparatus as claimed in claim 1, further comprising:

a plurality of guide pulleys that locate each tape pathway.

10. The apparatus as claimed in claim 1, further comprising:

the item support member and the tape members are selectively driven simultaneously and synchronously.

11. The apparatus as claimed in claim 1, further comprising:

a drive motor; and at least one clutch element; wherein the drive motor and clutch element drive the support member and the tape members in a dispense mode of operation or a deposit mode of operation.

12. A self-service terminal comprising the apparatus as claimed in claim 1, wherein each item of media comprises a currency note.

13. A teller assist unit comprising the apparatus as claimed in claim 1, wherein each item of media comprises a currency note.

14. A cash recycler unit comprising the apparatus as claimed in claim 1, wherein each item of media comprises a currency note.

15. A method for temporarily storing at least one item of media, comprising:

rotating an item support member having a substantially rounded rectangular cross-section with straight sides and rounded ends and comprising an outer support surface about an item support axis of rotation;

driving tape members along respective tape pathways each comprising a respective pathway portion in which the tape members extend in a co-operating relationship supported on said outer support surface and the rounded ends of the item support member; and supporting the tape members and at least one item of media located therebetween in a flat orientation on at least one support region of the outer support surface.

* * * * *